US007068964B2

(12) United States Patent
Martin

(10) Patent No.: US 7,068,964 B2
(45) Date of Patent: Jun. 27, 2006

(54) SYSTEMS AND METHODS FOR REMANUFACTURING IMAGING COMPONENTS

(75) Inventor: Thomas James Martin, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 58 days.

(21) Appl. No.: 10/972,798

(22) Filed: Oct. 25, 2004

(65) Prior Publication Data

US 2006/0088334 A1 Apr. 27, 2006

(51) Int. Cl.
*G03G 15/00* (2006.01)

(52) U.S. Cl. ..... 399/109; 399/120; 399/262

(58) Field of Classification Search ..... 399/106, 399/109, 110, 111, 113, 119, 120; 222/DIG. 1
See application file for complete search history.

(56) References Cited

FOREIGN PATENT DOCUMENTS

JP 2002-251119 * 9/2002

* cited by examiner

*Primary Examiner*—Hoang Ngo

(57) ABSTRACT

A method of remanufacturing an imaging cartridge comprising toner hopper not including a toner hopper access port comprises forming an access hole in a surface of the toner hopper, inserting toner into the toner hopper through the access hole, and adhering a hopper cap over the access hole to seal the access hole, the hopper cap comprising apparatus for facilitating removal of the hopper cap.

10 Claims, 8 Drawing Sheets

SYSTEMS AND METHODS FOR REMANUFACTURING IMAGING COMPONENTS

BACKGROUND

The present invention generally relates to manufacturing, remanufacturing or repairing replaceable imaging components, and more particularly to apparatus and techniques for sealing a compartment of a replaceable imaging cartridge holding marking material.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Imaging cartridges include one or more compartments holding the marking material which is deposited on a surface, such as paper. For a laser toner cartridge, this compartment is referred to as the toner hopper. During the remanufacture of a laser toner cartridge, any remaining residual toner should be removed from the toner hopper and the toner hopper should be cleaned. New toner is then placed in the toner hopper. Typically, this process is performed through a toner hopper access port provided on the toner cartridge by the original manufacturer of the toner cartridge (OEM) who also used this port to initially load the toner hopper with toner. In the case of certain toner cartridges, such as the toner cartridges for use with the HP 3500 and HP 3700 printers, the OEM filled the toner hopper in another fashion and thus the toner hopper does not include a toner hopper access port. Therefore, it would be advantageous to provide systems and methods for creating a toner hopper access port and providing a removable toner hopper cap for sealing the toner hopper access port.

SUMMARY

In one aspect of the present invention a method of remanufacturing an imaging cartridge comprising toner hopper not including a toner hopper access port comprises forming an access hole in a surface of the toner hopper, inserting toner into the toner hopper through the access hole, and adhering a hopper cap over the access hole to seal the access hole, the hopper cap comprising means for facilitating removal of the hopper cap.

In another aspect of the present invention, a hopper cap for covering an access hole formed in a toner hopper comprises a substantially planar hopper seal; an adhesive layer at least partially covering one side of the hopper seal; a release liner covering the adhesive layer, the release liner for removal prior to covering the access hole formed in the toner hopper; and a removal element for facilitating the removal of the hopper seal.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge comprising a toner hopper are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
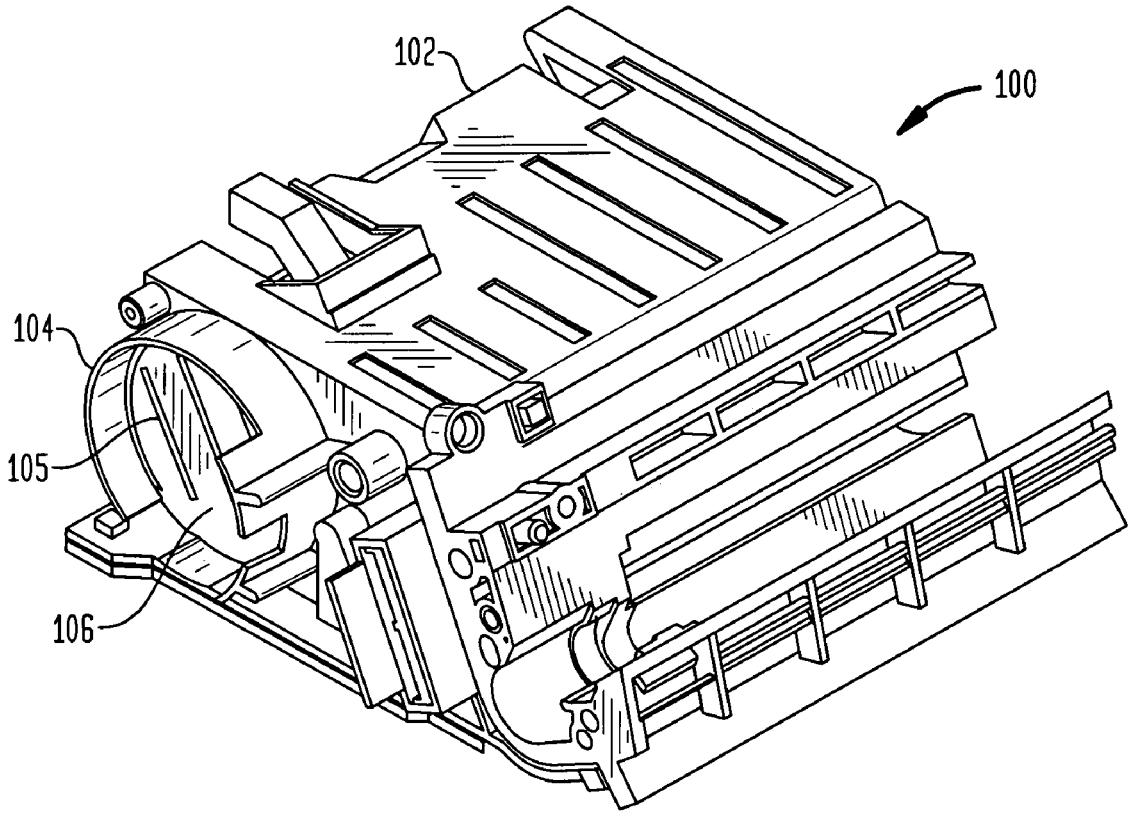
FIG. 1 (PRIOR ART)
FIG. 1 shows a perspective view of an end portion of an HP 3500 toner hopper.
Figure 2:
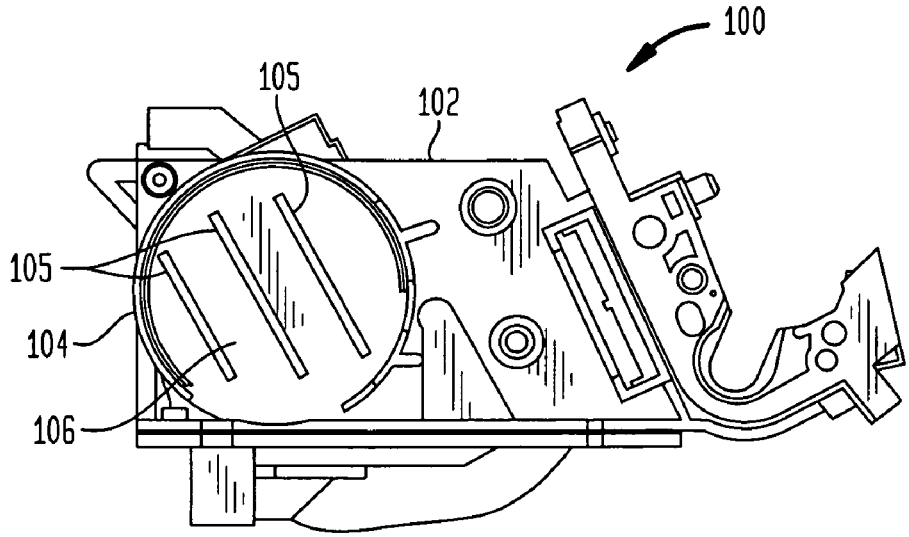
FIG. 2 (PRIOR ART)
FIG. 2 shows a side view of an end portion of an HP 3500 toner hopper.

FIGS. 1 and 2 show respectively a perspective view and a side view of an end portion of a toner hopper assembly 100 for use with a toner cartridge. Certain components such as the developer roller and end plates, for example, are not shown for ease of illustration. The toner hopper assembly 100 comprises a toner hopper body 102 which holds toner to be deposited on a material, such as paper. The toner hopper body 102 includes a generally circular band 104 partially surrounding a generally circular end portion 106. The end portion 106 may include one or more grooves 105. In a preferred embodiment, the toner hopper body 102 does not include a toner hopper access port for adding additional toner.

Figure 3:
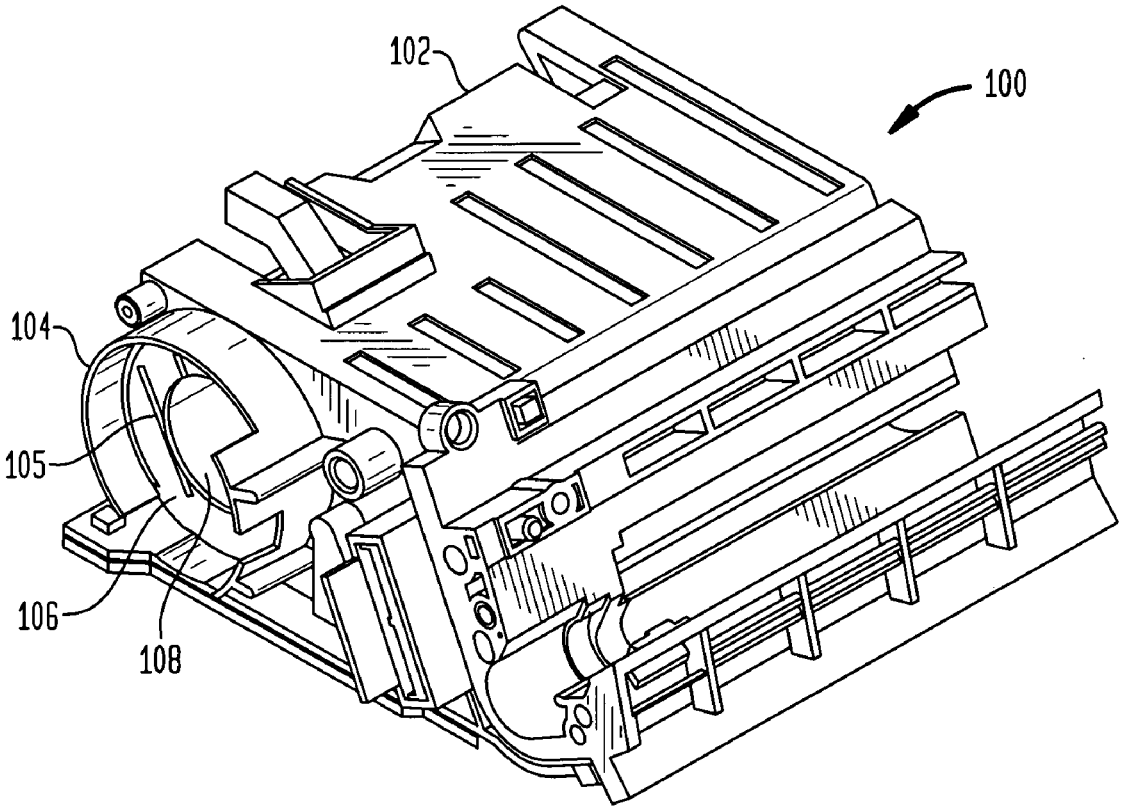
FIG. 3 shows a perspective view of an end portion of an HP 3500 toner hopper with an access hole in accordance with the present invention.
Figure 4:
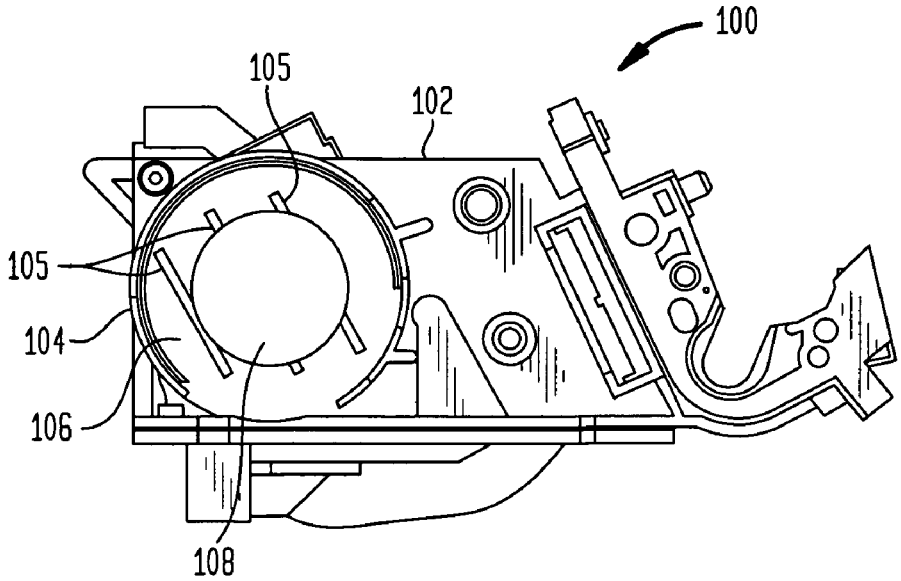
FIG. 4 shows a side view of an end portion of an HP 3500 toner hopper with an access hole in accordance with the present invention.

In order to access the interior of the toner hopper body 102 to remove any residual toner during the remanufacturing of the toner cartridge, an access hole 108 should be made in toner hopper body 102. FIGS. 3 and 4 show respectively a perspective view and a side view of an end portion of the toner hopper assembly 100 with the access hole 108 in accordance with the present invention. In a preferred embodiment, the access hole 108 is circular and is formed in the toner hopper body 102 near the center of the circular end portion 106. In one aspect, the circular end portion is substantially planar. The access hold 108 may be suitably formed by a variety of tools and methods including a hole saw, a drill bit, a utility knife, a Dremel® tool, a RotoZip® tool, laser cutting, and flame cutting, for example.

Figure 5:
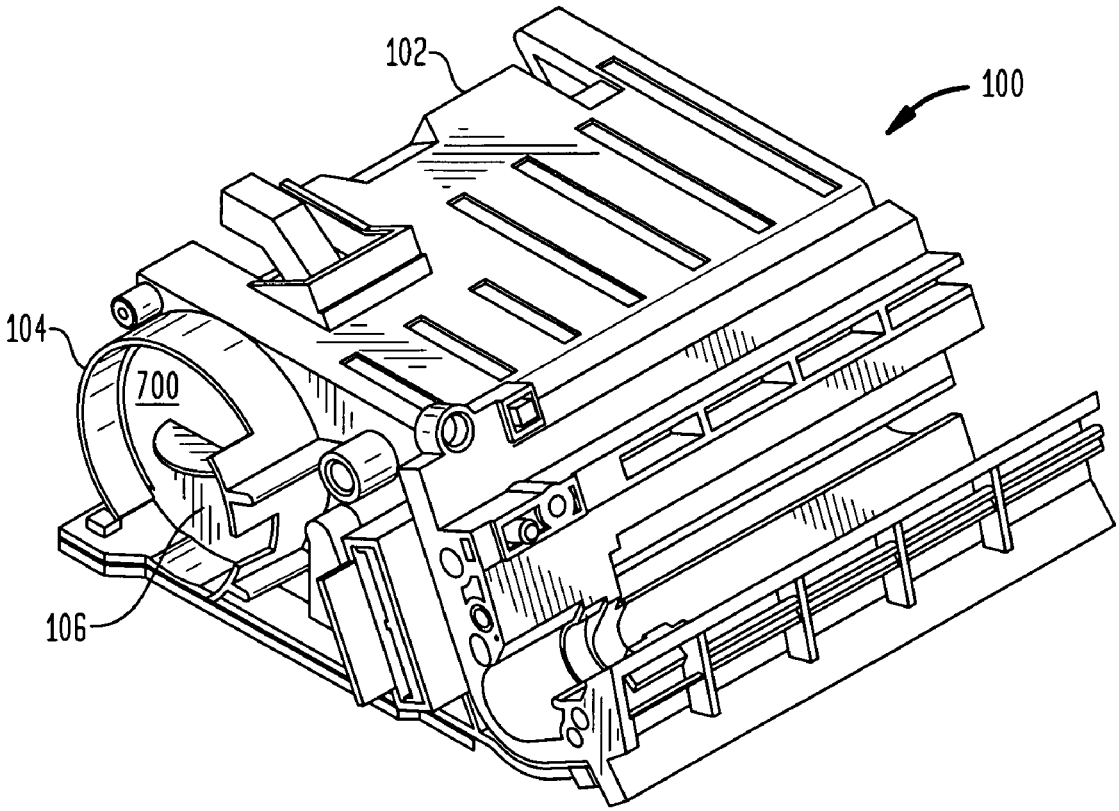
FIG. 5 shows a perspective view of an end portion of an HP 3500 toner hopper with an access hole sealed in accordance with the present invention.
Figure 6:
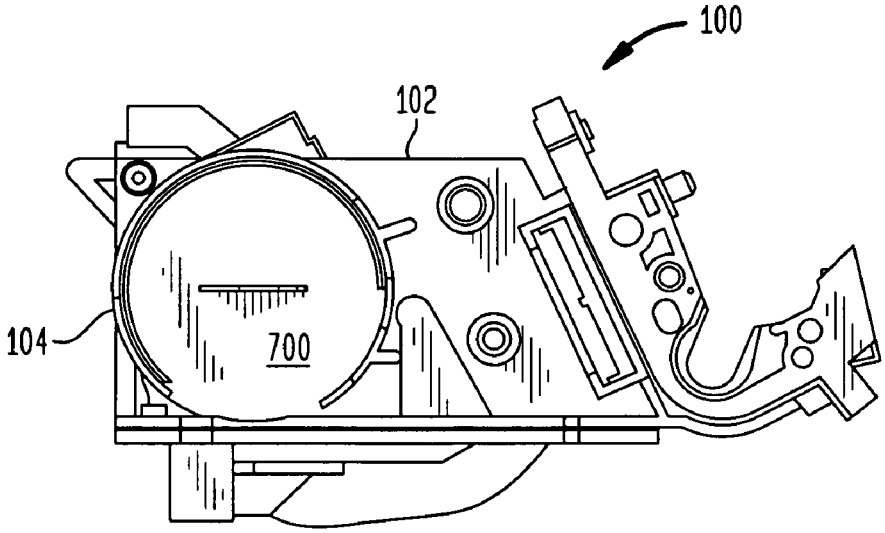
FIG. 6 shows a side view of an end portion of an HP 3500 toner hopper with an access hole sealed in accordance with the present invention.

After the toner hopper body 102 has been cleaned and filled with toner through the access hole 108, the surface 106 should be cleaned of any toner and the access hole should be sealed. FIGS. 5 and 6 show respectively a perspective view and a side view of an end portion of the toner hopper assembly 100 with the access hole 108 sealed in accordance with one aspect of the present invention. As seen in FIGS. 5 and 6, the access hole 108 is preferably sealed with a hopper cap 700.

Figure 7A:
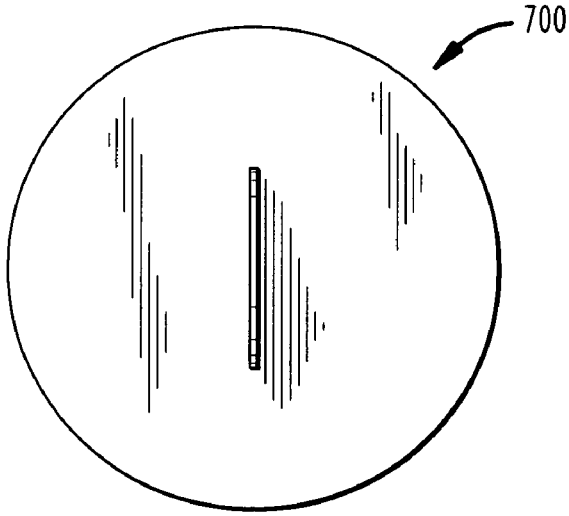
FIGS. 7A, 7B and 7C show respectively a top view, side view and perspective view of a first embodiment of a hopper cap in accordance with the present invention.
Figure 7B:
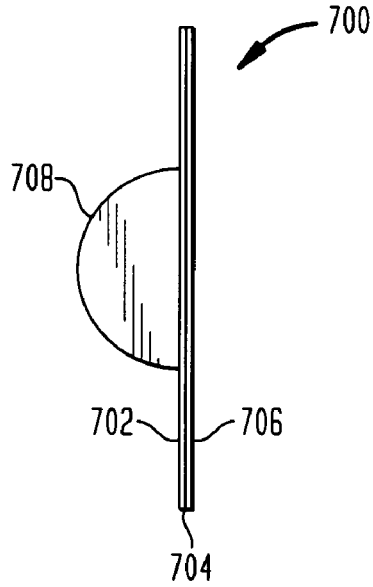
Figure 7C:
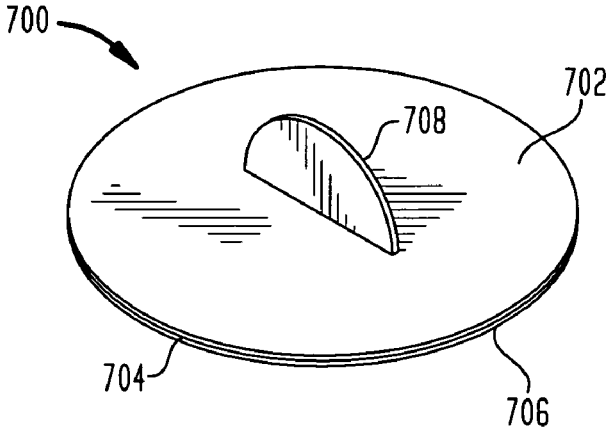

FIGS. 7A, 7B and 7C show respectively a top view, side view and perspective view of the hopper cap 700 in accordance with one embodiment of the present invention. The hopper cap 700 comprises a hopper seal 702 which is utilized to seal the access hole 108. Preferably, the hopper seal 702 is substantially planar and cylindrical in shape and has a larger diameter than the access hole 108. The hopper seal 702 may suitably comprise a material such as high impact polystyrene (HIPS). Attached to the hopper seal 702 is an adhesive layer 704 which adheres the hopper seal 702 to the end portion 106 surrounding the access hole 108. The adhesive layer 704 may suitably comprise Ultra High Adhesion (UHA) 1198 transfer tape from Avery Dennison Corporation. A release liner 706 protects the adhesive layer 704 prior to application and readily separates from the adhesive layer 704. The release liner 706 may suitably comprise a paper material, a synthetic material, or the like, for example. A removal handle 708 comprising HIPS is preferably thermoformed to one side of the hopper seal 702 to facilitate the removal of the hopper cap 700 during the next remanufacturing cycle to allow access to the access hole 108. The hopper cap 700 may be formed by diecutting using a dieboard. In a preferred embodiment, the hopper seal 702 is of sufficient size and shape to cover the grooves 105 to ensure that toner does not leak from the toner hopper 102 along the grooves 105 after the hopper cap 700 has been installed.

Figure 8A:
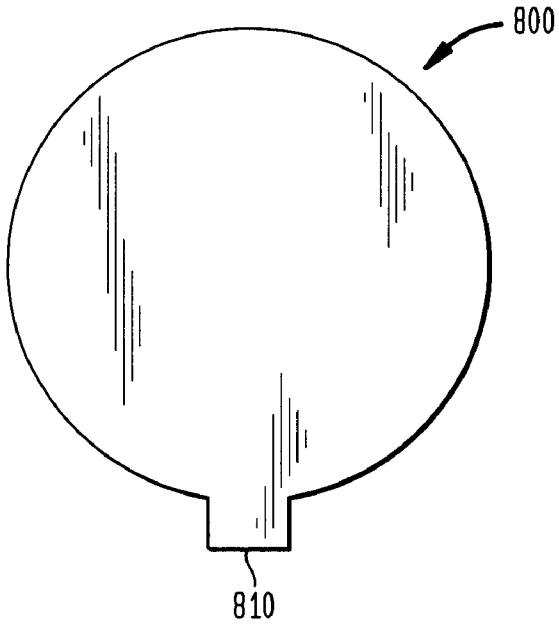
FIGS. 8A, 8B and 8C show respectively a top view, side view and perspective view of a second embodiment of a hopper cap in accordance with the present invention.
Figure 8B:
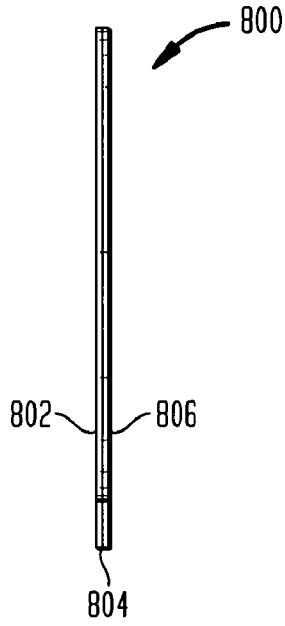
Figure 8C:
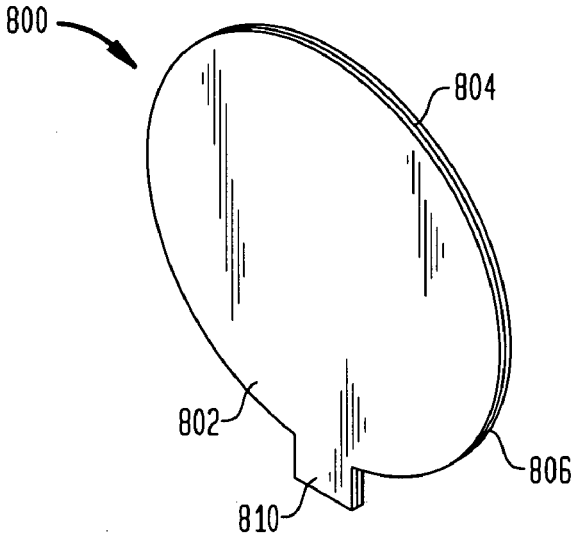

FIGS. 8A, 8B and 8C show respectively a top view, side view and perspective view of an alternate embodiment of a hopper cap 800 in accordance with another embodiment of the present invention. The hopper cap 800 comprises a hopper seal 802 which is utilized to seal the access hole 108. Preferably, the hopper seal 802 is substantially planar and generally cylindrical in shape and has a larger diameter than the access hole 108. The hopper seal 802 further includes a removal tab 810 on an edge of the hopper seal 802 to facilitate the removal of the hopper cap 800 during the next remanufacturing cycle to allow access to the access hole 108. The hopper seal 802 may suitably comprise a material such as HIPS. Attached to the hopper seal 802 is an adhesive layer 804 which adheres the hopper seal 802 to the end portion 106 surrounding the access hole 108. The adhesive layer 804 may suitably comprise Ultra High Adhesion (UHA) 1198 transfer tape from Avery Dennison Corporation. A release liner 806 protects the adhesive layer 804 prior to application and readily separates from the adhesive layer 804. The release liner 806 may suitably comprise a paper material, a synthetic material, or the like, for example. The hopper cap 800 may be formed by diecutting using a dieboard. In a preferred embodiment, the hopper seal 802 is of sufficient size and shape to cover the grooves 105 to ensure that toner does not leak from the toner hopper 102 along the grooves 105 after the hopper cap 800 has been installed.

Figure 9A:
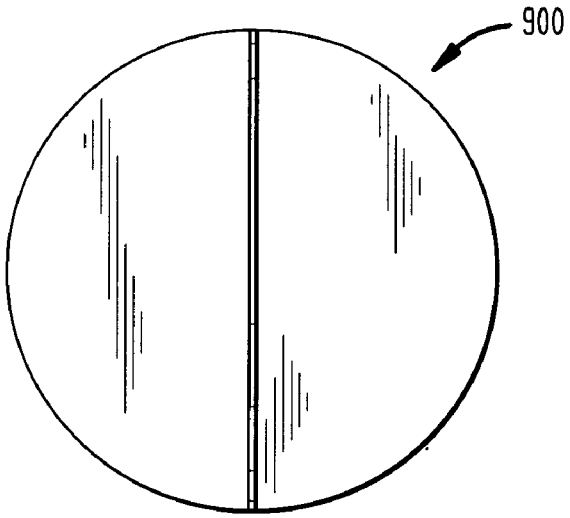
FIGS. 9A, 9B and 9C show respectively a top view, side view and perspective view of a third embodiment of a hopper cap in accordance with the present invention.
Figure 9B:
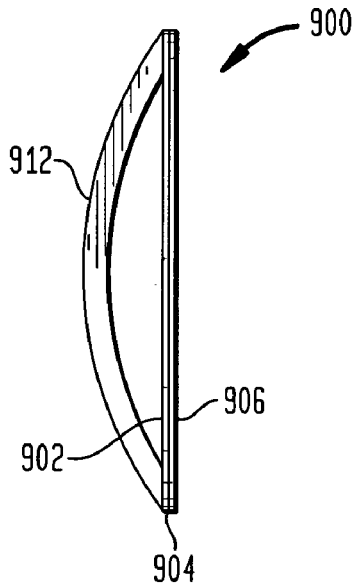
Figure 9C:
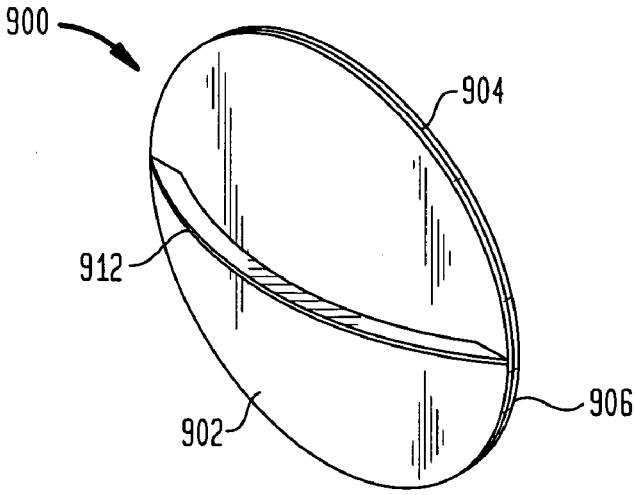

FIGS. 9A, 9B and 9C show respectively a top view, side view and perspective view of a hopper cap 900 in accordance with another embodiment of the present invention. The hopper cap 900 comprises a hopper seal 902 which is utilized to seal the access hole 108. Preferably, the hopper seal 902 is substantially planar and cylindrical in shape and has a larger diameter than the access hole 108. The hopper seal 902 may suitably comprise a material such as HIPS. Attached to the hopper seal 902 is an adhesive layer 904 which adheres the hopper seal 902 to the end portion 106 surrounding the access hole 108. The adhesive layer 904 may suitably comprise Ultra High Adhesion (UHA) 1198 transfer tape from Avery Dennison Corporation. A release liner 906 protects the adhesive layer 904 prior to application and readily separates from the adhesive layer 904. The release liner 906 may suitably comprise a paper material, a synthetic material, or the like, for example. A removal handle 912 comprising HIPS is preferably thermoformed to one side of the hopper seal 902 to facilitate the removal of the hopper cap 900 during the next remanufacturing cycle to allow access to the access hole 108. The hopper cap 900 may be formed by diecutting using a dieboard. In a preferred embodiment, the hopper seal 902 is of sufficient size and shape to cover the grooves 105 to ensure that toner does not leak from the toner hopper 102 along the grooves 105 after the hopper cap 900 has been installed.

Figure 10A:
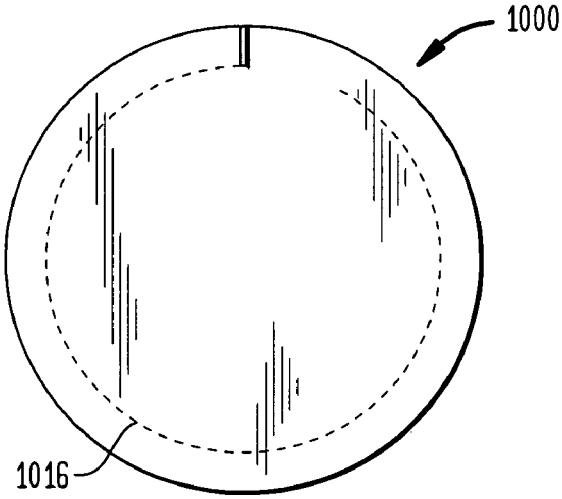
FIGS. 10A, 10B and 10C show respectively a top view, side view and perspective view of a fourth embodiment of a hopper cap in accordance with the present invention.
Figure 10B:
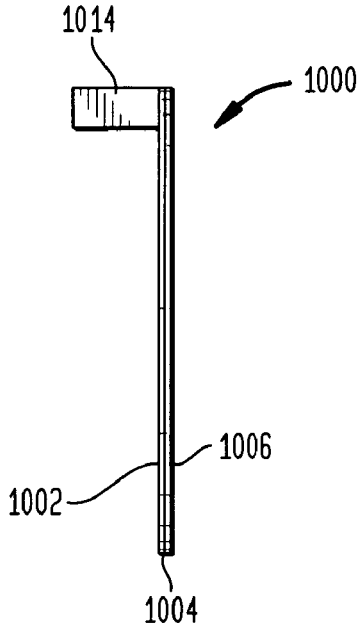
Figure 10C:
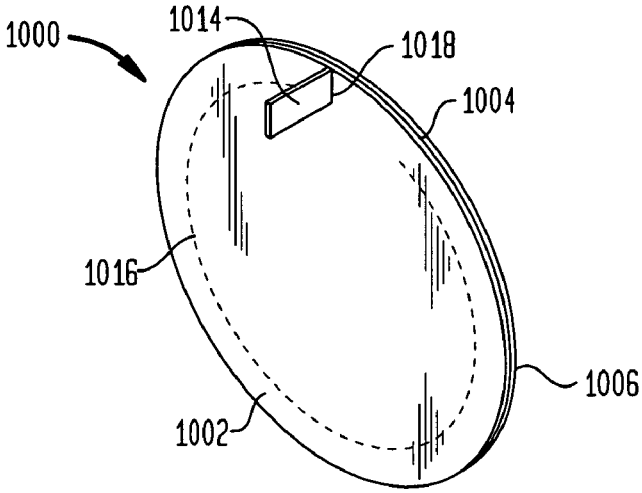

FIGS. 10A, 10B and 10C show respectively a top view, side view and perspective view of a hopper cap 1000 in accordance with another embodiment of the present invention. The hopper cap 1000 comprises a hopper seal 1002 which is utilized to seal the access hole 108. Preferably, the hopper seal 1002 is substantially planar and cylindrical in shape and has a larger diameter than the access hole 108. The hopper seal 1002 may suitably comprise a material such as HIPS. Attached to the hopper seal 1002 is an adhesive layer 1004 which adheres the hopper seal 1002 to the end portion 106 surrounding the access hole 108. The adhesive layer 1004 may suitably comprise Ultra High Adhesion (UHA) 1198 transfer tape from Avery Dennison Corporation. A release liner 1006 protects the adhesive layer 1004 prior to application and readily separates from the adhesive layer 1004. The release liner 1006 may suitably comprise a paper material, a synthetic material, or the like, for example. As shown in FIGS. 10–10C, a removal tab 1014 comprising HIPS is preferably thermoformed to one side of the hopper seal 1002. A generally circular arc of perforations 1016 formed in the hopper seal 1002 facilitates the removal of the hopper cap 1000 during the next remanufacturing cycle to allow access to the access hole 108. A user would pull on the removal tab 1014 and cause the hopper cap 1000 to tear along the perforations 1016. A perforation 1018 may also be formed along the base of the removal tab 1014. The hopper cap 1000 may be formed by diecutting using a dieboard. In a preferred embodiment, the hopper seal 1002 is of sufficient size and shape to cover the grooves 105 to ensure that toner does not leak from the toner hopper 102 along the grooves 105 after the hopper cap 1000 has been installed.

Figure 11A:
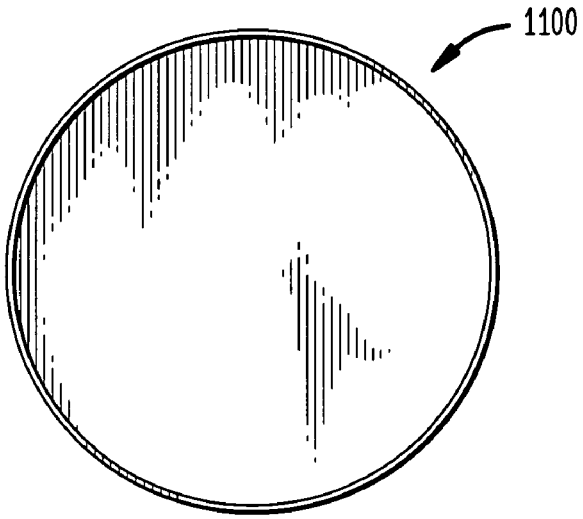
FIGS. 11A, 11B and 11C show respectively a top view, side view and perspective view of a fifth embodiment of a hopper cap in accordance with the present invention.
Figure 11B:
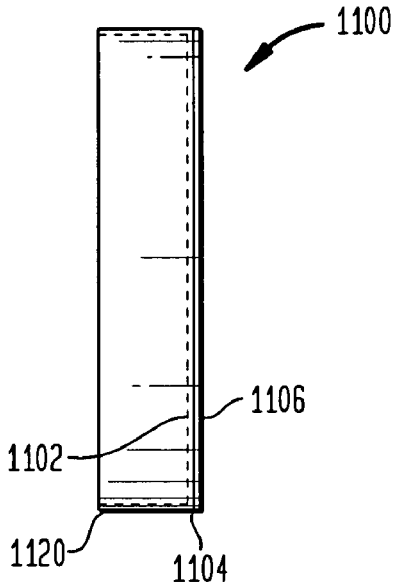
Figure 11C:
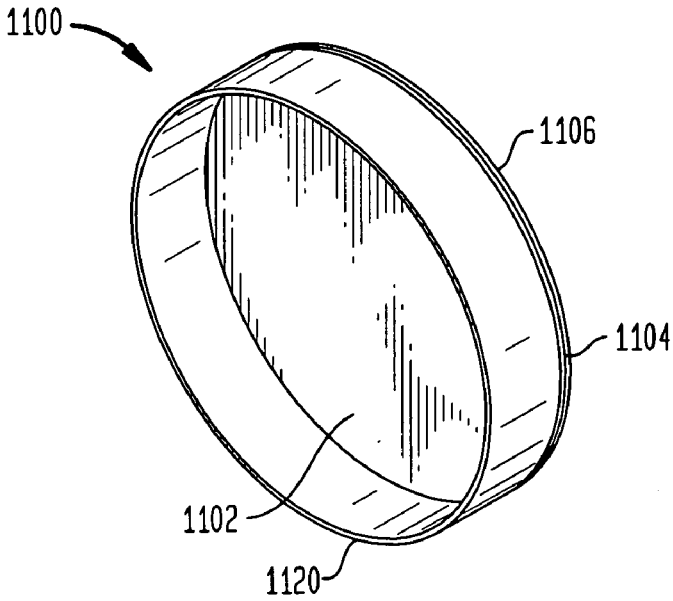

FIGS. 11A, 11B and 11C show respectively a top view, side view and perspective view of a hopper cap 1100 in accordance with another embodiment of the present invention. The hopper cap 1100 comprises a hopper seal 1102 which is utilized to seal the access hole 108. Preferably, the hopper seal 1102 is substantially planar and cylindrical in shape and has a larger diameter than the access hole 108. The hopper seal 1102 may suitably comprise a material such as HIPS. Attached to the hopper seal 1102 is an adhesive layer 1104 which adheres the hopper seal 1102 to the end portion 106 surrounding the access hole 108. The adhesive layer 1104 may suitably comprise Ultra High Adhesion (UHA) 1198 transfer tape from Avery Dennison Corporation. A release liner 1106 protects the adhesive layer 1104 prior to application and readily separates from the adhesive layer 1104. The release liner 1106 may suitably comprise a paper material, a synthetic material, or the like, for example. A cylindrical handle 1120 comprising HIPS is preferably thermoformed to one side of the hopper seal 1102 to facilitate the removal of the hopper cap 1100 during the next remanufacturing cycle to allow access to the access hole 108. The hopper cap 1100 may be formed by diecutting using a dieboard. In a preferred embodiment, the hopper seal 1102 is of sufficient size and shape to cover the grooves 105 to ensure that toner does not leak from the toner hopper 102 along the grooves 105 after the hopper cap 1100 has been installed.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of remanufacturing an imaging cartridge comprising a toner hopper, said toner hopper not including a toner hopper access port, the method comprising:

forming an access hole in a surface of the toner hopper;

inserting toner into the toner hopper through the access hole; and adhering a hopper cap over the access hole to seal the access hole, said hopper cap comprising means for facilitating removal of the hopper cap, wherein the hopper cap comprises a hopper seal, an adhesive layer at least partially covering one side of the hopper seal, and a release liner covering the adhesive layer, the method further comprising before the step of adhering the hopper cap;

removing the release liner from the side of a hopper cap having the adhesive layer.

2. The method of claim 1 wherein the access hole is substantially circular and the surface of the toner hopper is substantially planar.

3. The method of claim 2 wherein the hopper seal is sized to cover any grooves in the surface of the toner hopper.

4. The method of claim 2 wherein the means for facilitating removal of the hopper cap comprises a tab or a handle.

5. The method of claim 2 wherein the means for facilitating removal of the hopper cap is thermoformed to the hopper seal.

6. The method of claim 1 wherein the hopper seal comprises high impact polystyrene.

7. A hopper cap for covering an access hole formed in a surface of a toner hopper comprising:

a substantially planar hopper seal;

an adhesive layer at least partially covering one side of the hopper seal;

a release liner covering the adhesive layer, said release liner for removal prior to covering the access hole formed in the toner hopper; and a removal element for facilitating the removal of the hopper seal.

8. The hopper cap of claim 7 wherein the hopper seal is sized to cover any grooves in the surface of the toner hopper.

9. The hopper cap of claim 7 wherein the removal element is thermoformed to the hopper seal.

10. The hopper cap of claim 7 wherein the hopper seal comprises high impact polystyrene.

* * * * *